US011047174B2

(12) United States Patent
Wong et al.

(10) Patent No.: US 11,047,174 B2
(45) Date of Patent: Jun. 29, 2021

(54) DIGGING APPARATUS

(71) Applicant: TTI (MACAO COMMERCIAL OFFSHORE) LIMITED, Macao (CN)

(72) Inventors: Wai For Wong, New Territories (CN); Mark Tyson, Central (CN); Andrew Cameron, Vic (AU); Dong Lai Gu, Guangdong (CN); Zhi Hau Chen, Guangdong (CN)

(73) Assignee: TECHTRONIC CORDLESS GP, Anderson, SC (US)

( * ) Notice: Subject to any disclaimer, the term of this patent is extended or adjusted under 35 U.S.C. 154(b) by 0 days.

(21) Appl. No.: 16/497,019

(22) PCT Filed: Feb. 5, 2018

(86) PCT No.: PCT/CN2018/075276
§ 371 (c)(1),
(2) Date: Sep. 24, 2019

(87) PCT Pub. No.: WO2018/171346
PCT Pub. Date: Sep. 27, 2018

(65) Prior Publication Data

US 2020/0095830 A1 Mar. 26, 2020

(30) Foreign Application Priority Data

Mar. 24, 2017 (EP) ..... 17162856

(51) Int. Cl.
*E21B 7/02* (2006.01)
*E21B 11/00* (2006.01)

(52) U.S. Cl.
CPC ..... *E21B 7/022* (2013.01); *E21B 7/028* (2013.01); *E21B 11/005* (2013.01)

(58) Field of Classification Search
CPC ..... E21B 7/005; E21B 7/028; E21B 11/005; H02K 7/145; F02D 11/107; F02D 11/02; F02D 41/22; F02B 63/02
See application file for complete search history.

(56) References Cited

U.S. PATENT DOCUMENTS 3,012,441 A * 12/1961 Lamb ..... B24B 23/02 74/16
4,671,367 A 6/1987 Brunsing et al.
(Continued)

FOREIGN PATENT DOCUMENTS

CN 201152938 Y 11/2008
CN 101775961 A 7/2010
(Continued)

OTHER PUBLICATIONS

TTI (Macao Commercial Offshore) Limiied;AU Patent Application No. 2018206792; Examination Report; dated Dec. 10, 2019; (2 pages).
(Continued)

*Primary Examiner* — Jennifer H Gay
(74) *Attorney, Agent, or Firm* — Dority & Manning, P.A.

(57) ABSTRACT

A digging apparatus (10, 300) is disclosed. The digging apparatus (10,300) includes a handle assembly (14, 14*a*, 314), a motor (32), a main switch (22, 322) electrically connected with the motor (32). The main switch (22,322) is movable between a first position in which operation of the motor (32) is allowed and a second position in which operation of the motor (32) is prevented, and a drilling bit (88, 88*a*, 388) is driven by the motor (32). The drilling bit (88, 88*a*, 388) has a longitudinal axis (P-P, M-M), and when the switch member (22, 322) is in the first position, the motor (32) is adapted to drive the drilling bit (88, 88*a*, 388) to rotate about the longitudinal axis (P-P, M-M) in a clockwise direction in response to pushing of the handle assembly
(Continued)

(14, 14*a*, 314) in a direction towards the drilling bit (88, 88*a*, 388), and the motor (32) is adapted to drive the drilling bit (88, 88*a*, 388) to rotate about the longitudinal axis (P-P, M-M) in an anti-clockwise direction in response to pulling of the handle assembly (14, 14*a*, 314) in a direction away from the drilling bit (88, 88*a*, 388).

29 Claims, 12 Drawing Sheets

(56) References Cited

U.S. PATENT DOCUMENTS

| | | | | |
|---|---|---|---|---|
| 5,014,793 | A * | 5/1991 | Germanton | B25B 21/00 173/181 |
| 5,358,062 | A * | 10/1994 | Uhl | E21B 44/00 175/394 |
| 6,460,627 | B1 | 10/2002 | Below et al. | |
| 6,479,958 | B1 | 11/2002 | Thompson et al. | |
| 7,750,587 | B2 * | 7/2010 | Mueller | H02P 7/29 318/461 |
| 9,270,152 | B2 * | 2/2016 | Schamberger | E21B 7/005 |
| 9,314,855 | B2 * | 4/2016 | Ookubo | H02P 27/08 |
| 9,506,295 | B1 * | 11/2016 | Blum | E02D 5/34 |
| 9,561,546 | B1 * | 2/2017 | Walter | B01F 7/00641 |
| 9,926,857 | B2 * | 3/2018 | Lyu | F02D 11/10 |
| 10,220,500 | B2 * | 3/2019 | Lim | B25F 5/001 |
| 10,689,909 | B2 * | 6/2020 | Wang | E21B 3/02 |
| 2009/0065225 | A1 | 3/2009 | Forster et al. | |
| 2009/0228177 | A1 | 9/2009 | Mintah et al. | |
| 2010/0060022 | A1 * | 3/2010 | Alcov | A01C 5/02 294/50.7 |
| 2010/0074702 | A1 | 3/2010 | Kluge | |
| 2011/0284255 | A1 * | 11/2011 | Ookubo | H02P 27/08 173/109 |
| 2013/0014996 | A1 * | 1/2013 | Ruppel | E21B 7/027 175/170 |
| 2014/0174824 | A1 * | 6/2014 | Schamberger | H02K 7/145 175/18 |
| 2014/0216773 | A1 | 8/2014 | Steurer | |
| 2014/0231113 | A1 | 8/2014 | Steurer | |
| 2016/0319752 | A1 * | 11/2016 | Lyu | F02B 63/02 |
| 2016/0354888 | A1 | 12/2016 | Huber et al. | |
| 2019/0195019 | A1 * | 6/2019 | Wang | E21B 7/04 |
| 2020/0095830 | A1 * | 3/2020 | Wong | E21B 11/005 |

FOREIGN PATENT DOCUMENTS

| | | | | |
|---|---|---|---|---|
| CN | 201874482 | U | 6/2011 | |
| CN | 103481251 | A * | 1/2014 | B25F 5/001 |
| CN | 103999604 | A | 8/2014 | |
| CN | 105735889 | A | 7/2016 | |
| CN | 205408485 | U | 8/2016 | |
| CN | 205510756 | U | 8/2016 | |
| EP | 3379019 | A1 * | 9/2018 | E21B 11/005 |
| FR | 2694334 | A1 * | 2/1994 | E21B 44/04 |
| WO | WO-2010087206 | A1 * | 8/2010 | B25D 16/006 |
| WO | WO-2017159201 | A1 * | 9/2017 | B25F 5/00 |

OTHER PUBLICATIONS

TTI (Macao Commercial Offshore) Limited; International Patent Application No. PCT/CN2018/075276; International Search Report; dated May 10, 2018; (2 pages).

* cited by examiner

DIGGING APPARATUS

This application is a National Stage Patent Application of PCT/CN2018/075276, filed on Feb. 5, 2018, which claims the benefit of priority to European Patent Application No. EP17162856.3, filed on Mar. 24, 2017, the disclosures of all of which are incorporated by reference herein in their entireties.

This invention relates to a digging apparatus, and in particular such a digging apparatus suitable, but not exclusively, for digging into soil.

Most commercially available digging apparatus include a motor driving a rotatable drilling bit. Some such apparatus only allow one-way drilling, i.e. rotation of the drilling hit in one direction only. They therefore do not allow for reverse rotation of the drilling hit, which is in fact a desirable feature as it helps the drilling bit out of the substrate being drilled or dug, e.g. soil. While some digging apparatus allow choice of drilling direction by pressing a button, it would mean that a user has to press a button every time he/she wants to change the drilling direction of the drilling bit.

in addition, most existing mechanisms allowing releasable engagement of drilling bits to a digging apparatus are complex to manufacture and operate, and may also require the use of other tools. Furthermore, most existing digging apparatus have a closed-loop handle. Such a kind of handle suffers from the drawback that, when kickback occurs, a hand or hands of a user may be easily hit by such a closed-loop handle. Moreover, kickback may occur in case of a sudden large torque faced by the drilling bit (and thus the motor), which may hurt the user. A system for preventing or at least mitigating the effect of kickback is thus required.

It is thus an object of the present invention to provide a digging apparatus and a digging tool for a digging apparatus in which the aforesaid shortcomings are mitigated, or at least to provide useful alternatives to the trade and public.

According to a first aspect of the present invention, there is provided a digging apparatus including a motor, and a digging tool drivenable by said motor, said digging tool having a longitudinal axis, wherein said motor is adapted to selectively drive said digging tool to rotate about said longitudinal axis in a first rotational direction and a second rotational direction which is opposite to said first rotational direction, further including a measuring device for measuring the angular velocity of said digging tool, and a controller for stopping operation of said motor in response to the angular velocity of said digging tool as measured by said measuring device exceeding threshold angular velocity value.

According to a second aspect of the present invention, there is provided a digging apparatus including a handle assembly, a motor, a switch member electrically connected with said motor, said switch member being movable between a first position in which operation of said motor is allowed and a second position in which operation of said motor is prevented, and a digging tool drivenable by said motor, said digging tool having a longitudinal axis, characterized in that, when said switch member is in said first position, said motor is adapted to drive said digging tool to rotate about said longitudinal axis in a first rotational direction in response to movement of said handle assembly in a first direction, and said motor is adapted to drive said digging tool to rotate about said longitudinal axis in a second rotational direction which is opposite to said first rotational direction in response to movement of said handle assembly in a second direction which is substantially opposite to said first direction.

According to a third aspect of the present invention, there is provided a digging tool for a digging apparatus, said digging tool including a body with a plurality of markings thereon for indicating a depth of penetration of said digging tool into a substrate.

According to a fourth aspect of the present invention, there is provided a digging tool for a digging apparatus, said digging tool including a first longitudinal end for penetrating into a substrate, an opposite second longitudinal end for releasable connection with a digging apparatus, and a hollow connection part adjacent said second longitudinal end, wherein said hollow connection part includes two through-holes with their central longitudinal axes aligned with each other.

Digging apparatus and a digging tool according to the present invention will now be described, by way of examples only, with reference to the accompany drawings, in which.

Figure 1:
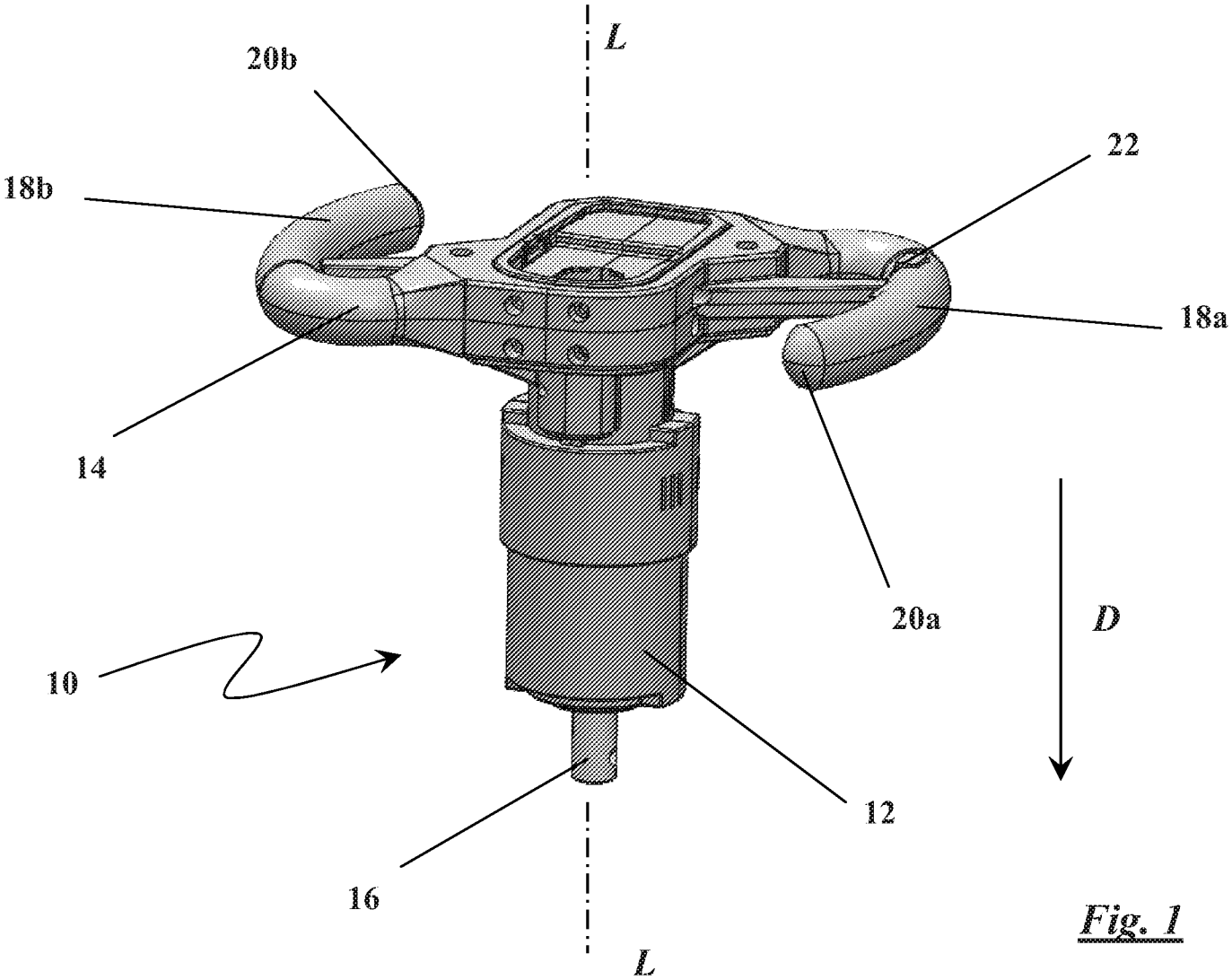
FIG. 1 is a perspective view of a main body of a digging apparatus according to a first embodiment of the present invention.

FIG. 1 shows a perspective view of a main body 12 of a digging apparatus according to a first embodiment of the present invention, generally designated as 10. The main body 12 includes a handle assembly 14 at one longitudinal end thereof and an output shaft 16 at an opposite longitudinal end thereof. As will be discussed below, one longitudinal end of the output shaft 16 is connected with a motor of the digging apparatus 10 and an opposite longitudinal end of the output shaft 16 is releasably connected with a digging tool, such as a drilling bit. The main body 12 has a central longitudinal axis L-L.

Figure 2:
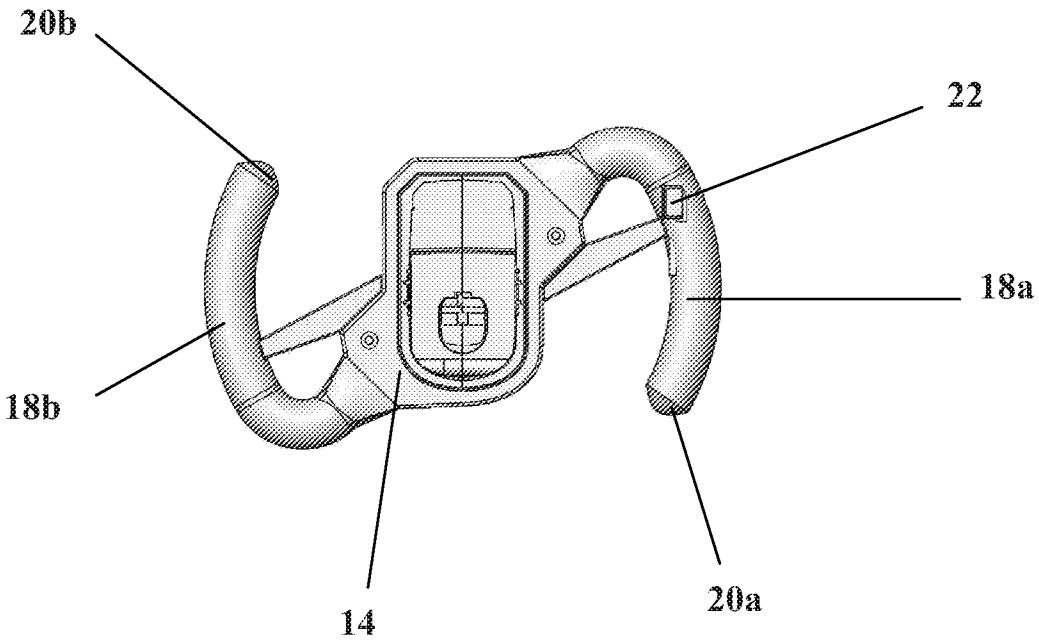
FIG. 2 is a top view of a handle assembly of the digging apparatus of FIG. 1.

FIG. 2 shows a top view of the handle assembly 14 of the digging apparatus 10. The handle assembly 14 is in a generally S-shape, and has two handle portions 18*a*, 18*b*, each with a respective free end 20*a*, 20*b* pointing towards generally opposite directions. As mentioned above, most existing digging apparatus have a closed-loop handle, and such a kind of handle suffers from the drawback that, when kickback occurs, a hand of a user or hands may be easily hit by such a closed-loop handle. With the S-shaped handle assembly 14 of the present invention, however, in addition to be grasped easily, when kickback occurs, a user can easily let loose of the handle assembly 14 from the free ends 18*a*, 18*b*, thus not having to withstand the kickback force, and reducing the risk of being hurt by the digging apparatus 10.

A main switch 22 is provided on the handle portion 18*a*, to be manually operable by a user. The main switch 22 may be moved between an "ON" position and an "OFF" position. When the main switch 22 is in the "OFF" position, the motor (to be discussed below) of the digging apparatus 10 is prevented from being operated. When the main switch 22 is in the "ON" position, the motor of the digging apparatus 10 may be operated upon activation of a switch mechanism to be discussed below.

Figure 3:
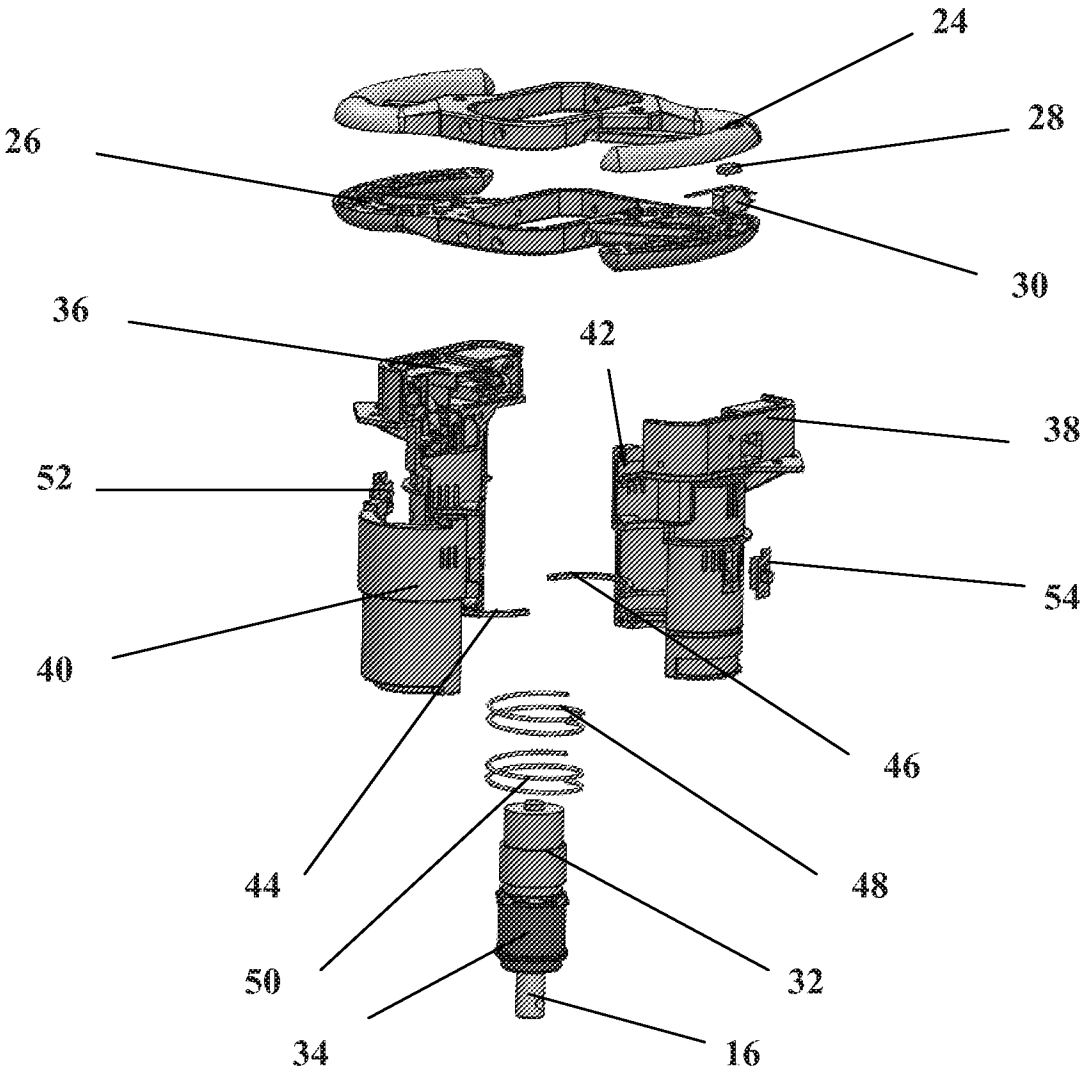
FIG. 3 is an exploded view of the main body of the digging apparatus of FIG. 1.
Figure 4B:
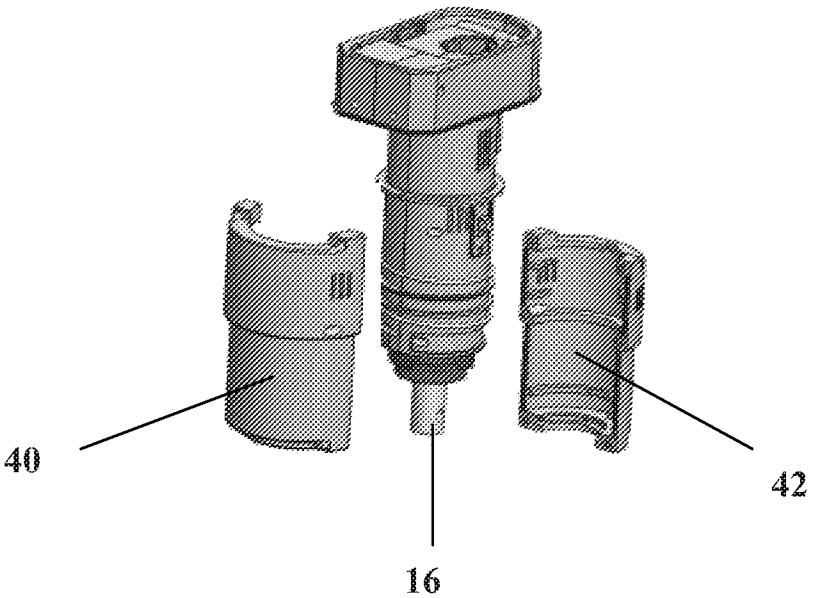
FIGS. 4A to 4D show steps of assembling the main body of the digging apparatus of FIG. 1.
Figure 4A:
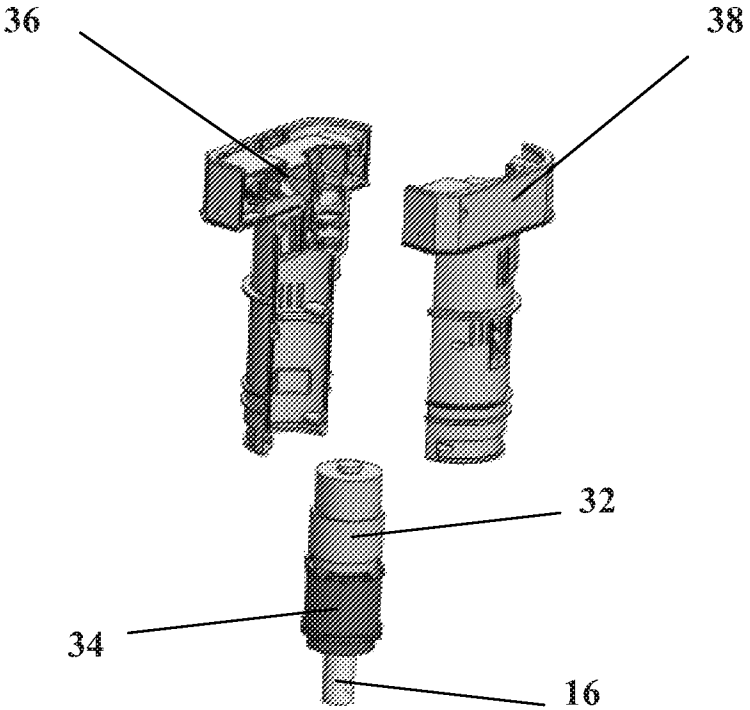
Figure 4D:
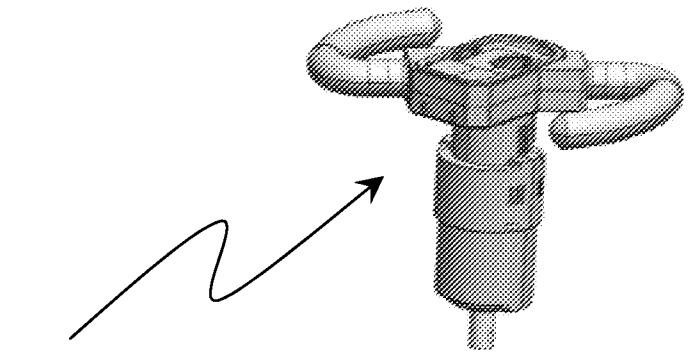
Figure 4C:
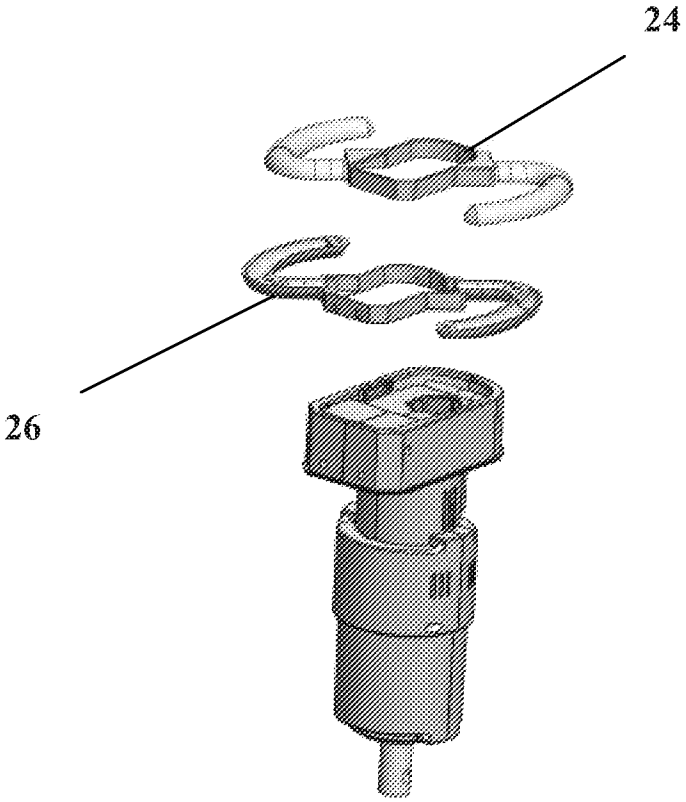

As shown in FIG. 3, the handle assembly 14 of the main body 12 includes an upper handle part 24 and a lower handle part 26, with the main switch 22 including a push button 28 operatively associated with a micro-switch 30 which is electrically connected with a motor 32, such as a brushed motor. The motor 32 is connected with the output shaft 16 via a gear box 34. The main body 12 includes a left body housing 36, a right body housing 38, a left outer housing 40, a right outer housing 42, springs 44, 46, spring holders 48, 50, a first slide switch 52, and a second slide switch 54. The motor 32, the main switch 22 (including the micro-switch 30), the first slide switch 52 and the second slide switch 54 are all electrically connected with one another via an electric circuit. The first slide switch 52 and the second slide switch 54 form an auxiliary switch assembly 55, which co-operates with the main switch 22 in operating the digging apparatus 10.

As shown in FIGS. 4A to 4D, to assemble the main body 12 of the digging apparatus 10, the motor 32 and the gear box 34 are connected with each other, and are enclosed within a cavity between the left body housing 36 and the right body housing 38, with a part of the gear box 34 and the output shaft 16 extending outside the left body housing 36 and the right body housing 38. The thus assembled portion is then encased between the left outer housing 40 and the right outer housing 42, again with a part of the gear box 34 and the output shaft 16 extending outside the left outer housing 40 and the right outer housing 42. The upper handle part 24 and the lower handle 26 part, are then assembled on top of the thus assembled portion to form the main body 12.

Figure 5:
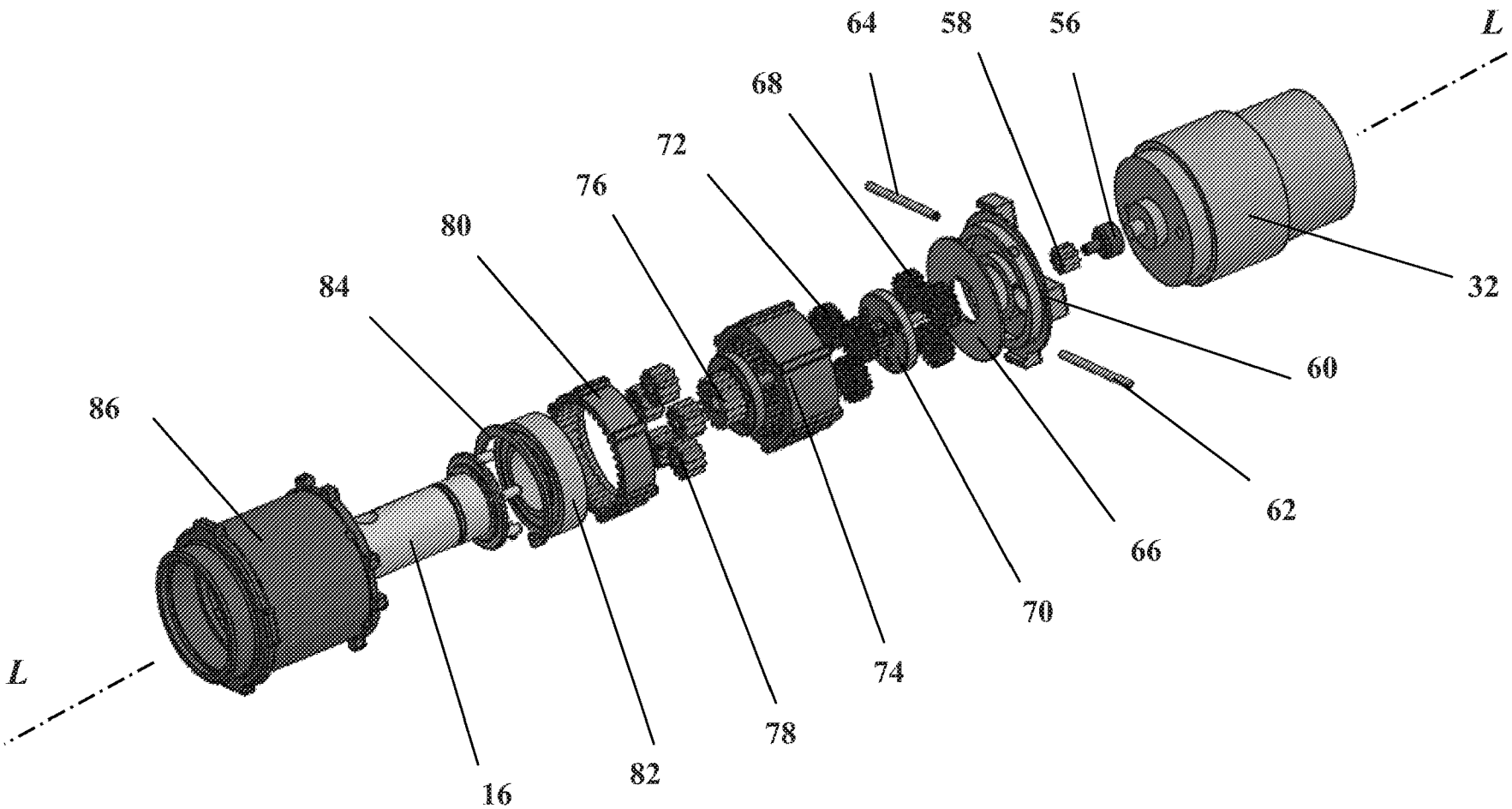
FIG. 5 is an exploded view of a gear box of the main body of the digging apparatus of FIG. 1.

As shown in more detail in FIG. 5, the gear box 34 of the main body 12 of the digging apparatus 10 includes a pinion adaptor 56 coupled to a pinion 58, a motor mount 60, two gear box pins 62, 64, a washer 66, a first layer planetary gear 68, a first layer planet carrier 70, a second layer planetary gear 72, a first ring gear 74, a second layer planet carrier 76, a third layer planetary gear 78, a second ring gear 80, a bearing 82, a retaining ring 84, and a gear box housing 86.

According to the present invention, a drilling bit is releasably connected with and driven by the motor 32 via the output shaft 16 of the main body 12 to form the digging apparatus 10. To operate the digging apparatus 10, the main switch 22 is moved (e.g. by moving the push button 28) from the "OFF" position to and remain at the "ON" position to activate the micro-switch 30. A user holding the handle assembly 14 of the digging apparatus 10 then moves (e.g. pushes) the handle assembly 14 in a direction parallel to the central longitudinal axis L-L of the digging apparatus 10 and from the handle assembly 14 towards the output shaft 16 (and thus towards the drilling bit), as shown by the arrow D in FIG. 1. When in use, e.g. when the drilling bit of the digging apparatus 10 abuts or penetrates a substrate to be dug (e.g. soil), as the central longitudinal axis L-L of the digging apparatus 10 extends generally vertically, this direction of movement of the handle assembly 14 is generally downward. Upon movement of the handle assembly 14 in this direction, the first slide switch 52 is activated to close the electric circuit in a configuration in which electricity is supplied to activate the motor 32 to drive the output shaft 16 to rotate in a clockwise direction (when seen from top) to cause the drilling bit to rotate in the same rotational direction, to dig and move downward into the substrate, thus also moving the digging apparatus 10 downward into the substrate.

If desired, the user may (while maintaining the main switch 22 in the "ON" position) move (e.g. pull) the handle assembly 14 in a direction opposite to that indicated by the arrow Din FIG. 1 (i.e. parallel to the central longitudinal axis L-L of the digging apparatus 10 and from the output shaft 16 (or from the drilling bit) towards the handle assembly 14). When in use, e.g. when the drilling bit of the digging apparatus 10 penetrates a substrate to be dug (e.g. soil), as the central longitudinal axis L-L of the digging apparatus 10 extends generally vertically, this direction of movement of the handle assembly 14 is generally upward. Upon movement of the handle assembly 14 in this direction, the first slide switch 52 is deactivated, while the second slide switch 54 is activated to close the electric circuit in a different configuration in which electricity is supplied to activate the motor 32 to drive the output shaft 16 to rotate in an opposite, anti-clockwise direction (when seen from top) to cause the drilling bit to rotate in the same rotational direction, to move upward and away from the substrate, thus also moving the digging apparatus 10 upward and away from the substrate. More particularly, when the main switch 22 and the first slide switch 52 are activated, the first slide switch 52 closes the electric circuit in a configuration in which electricity is supplied to the motor 32 in a direction to cause the output shaft 16 of the motor 32 to rotate in the clockwise direction (when seen from top), and when the main switch 22 and the second slide switch 54 are activated, the second slide switch 54 closes the electric circuit in a different configuration in which electricity is supplied to the motor 32 in an opposite direction to cause the output shaft 16 of the motor 32 to rotate in the opposite, anti-clockwise direction (when seen from top).

By way of the aforesaid arrangement of the digging apparatus 10 according to the present invention, auto selection of forward/rearward movement of the digging apparatus 10 into and out of the substrate to be dug is allowed. This enables the user to finish the work quicker as there is no need to manually push any button to select the direction of rotation of the drilling bit (and thus the direction of movement of the digging apparatus 10. Such an auto selection of forward/rearward movement of the digging apparatus 10 also fits in with human habit, as, normally, a user pushes the digging apparatus 10 downward if he/she wants to dig deeper, and the user pulls the digging apparatus 10 upward if he/she wants to retrieve the digging apparatus 10. Such a feature also allows the user to cause the drilling bit to drill back and forth in the substrate more easily and conveniently, without having to push any button manually.

It should be noted that the motor 32 can only operate either when both the main switch 22 and the first slide switch 52 are simultaneously activated, or when both the main switch 22 and the second slide switch 54 are simultaneously activated. Such an arrangement enhances the safety in use of the digging apparatus 10. Thus, in a way, the main switch 22 acts as a safety switch.

Figures 6A, 6B, 6C:
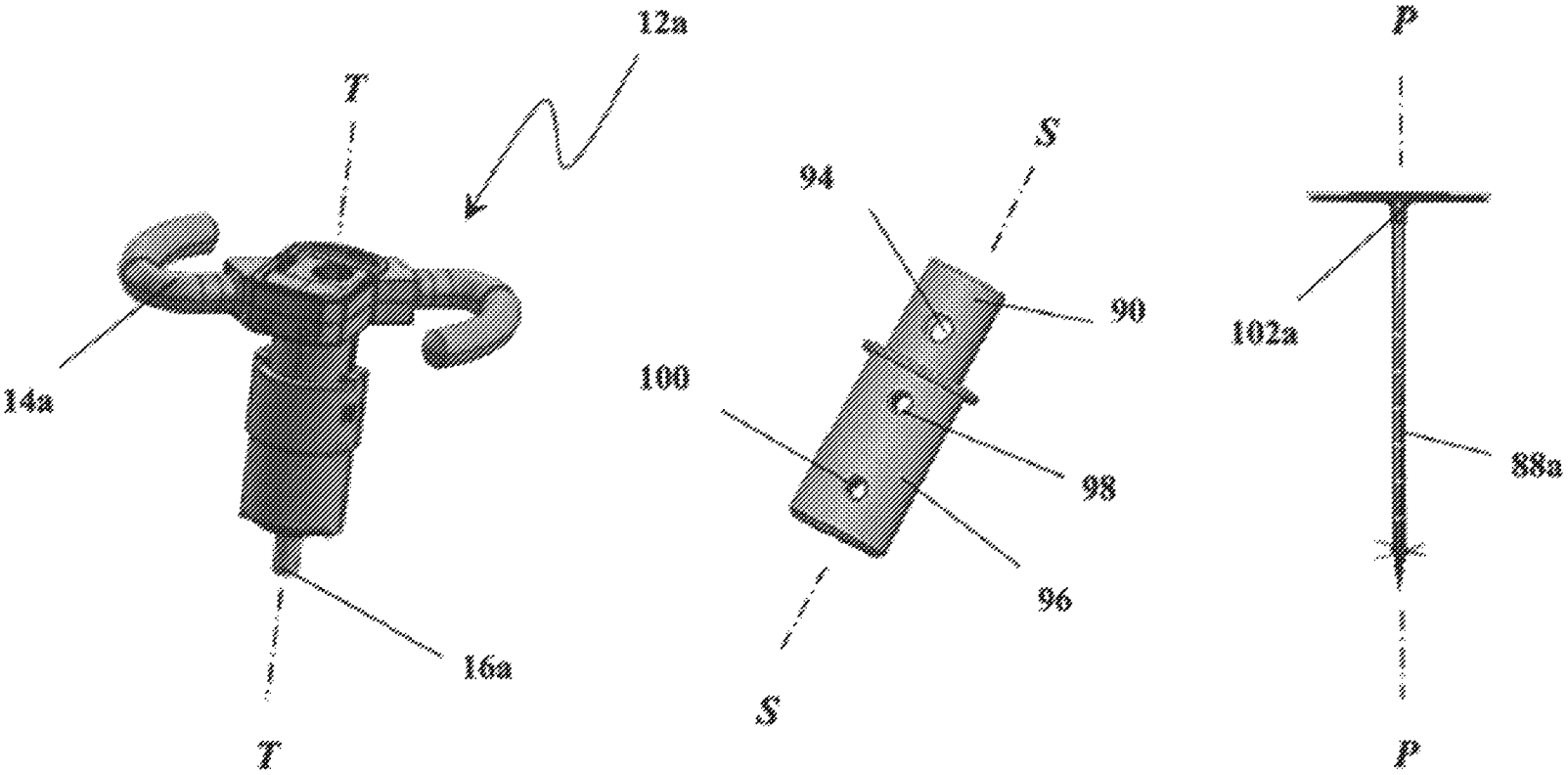
FIG. 6A is a perspective view of a main body of a digging apparatus according to a second embodiment of the present invention.
FIG. 6B is a perspective view of an adaptor for use with the main body of FIG. 6A.
FIG. 6C is a front view of a drilling bit for use with the adaptor of FIG. 6B.

FIG. 6A shows a main body 12*a* of a digging apparatus 10 according to second embodiment of the present invention. The structure of the main body 12*a* is highly similar to that of the main body 12 discussed above, the only difference being the detailed shape of the respective handle assembly 14, 14*a*. An output shaft 16*a* of the main body 12*a* (with a central longitudinal axis T-T) is releasably connected with a drilling bit 88*a* with a central longitudinal axis P-P, as shown in FIG. 6C, via an adaptor 90 with a central longitudinal axis S-S, as shown in FIG. 6B. The adaptor 90 has an upper hollow cylindrical part 92 with two through holes 94 with their central longitudinal axes aligned with each other. The hollow cylindrical part 92 receives part of the output shaft 16*a* of the main body 12*a*, and may be releasably connected with the output shaft 16*a* by a lock pin (not shown) going through the through holes 94 and correspondingly positioned through hole (not shown) through the output shaft 16*a*. The adaptor 90 also has a lower hollow cylindrical part 96 with two pairs of through holes 98, 100, with their respective pair of central longitudinal axes aligned with each other. An upper end of the 102*a* of the drilling bit 88*a* may be releasably connected with the lower hollow cylindrical part 96 of the adaptor 90 by bolts and nuts, and with possible length adjustment, depending on which pair of aligned holes 98, 100 are used. When the drilling bit 88*a* is thus releasably engaged with the main body 12*a*, the central longitudinal axis T-T of the main body 12*a*, the central longitudinal axis P-P of the drilling bit 88*a* and the central longitudinal axis S-S of the adaptor 90 are aligned with one another.

Figures 7A, 7B, 7C, 7D:
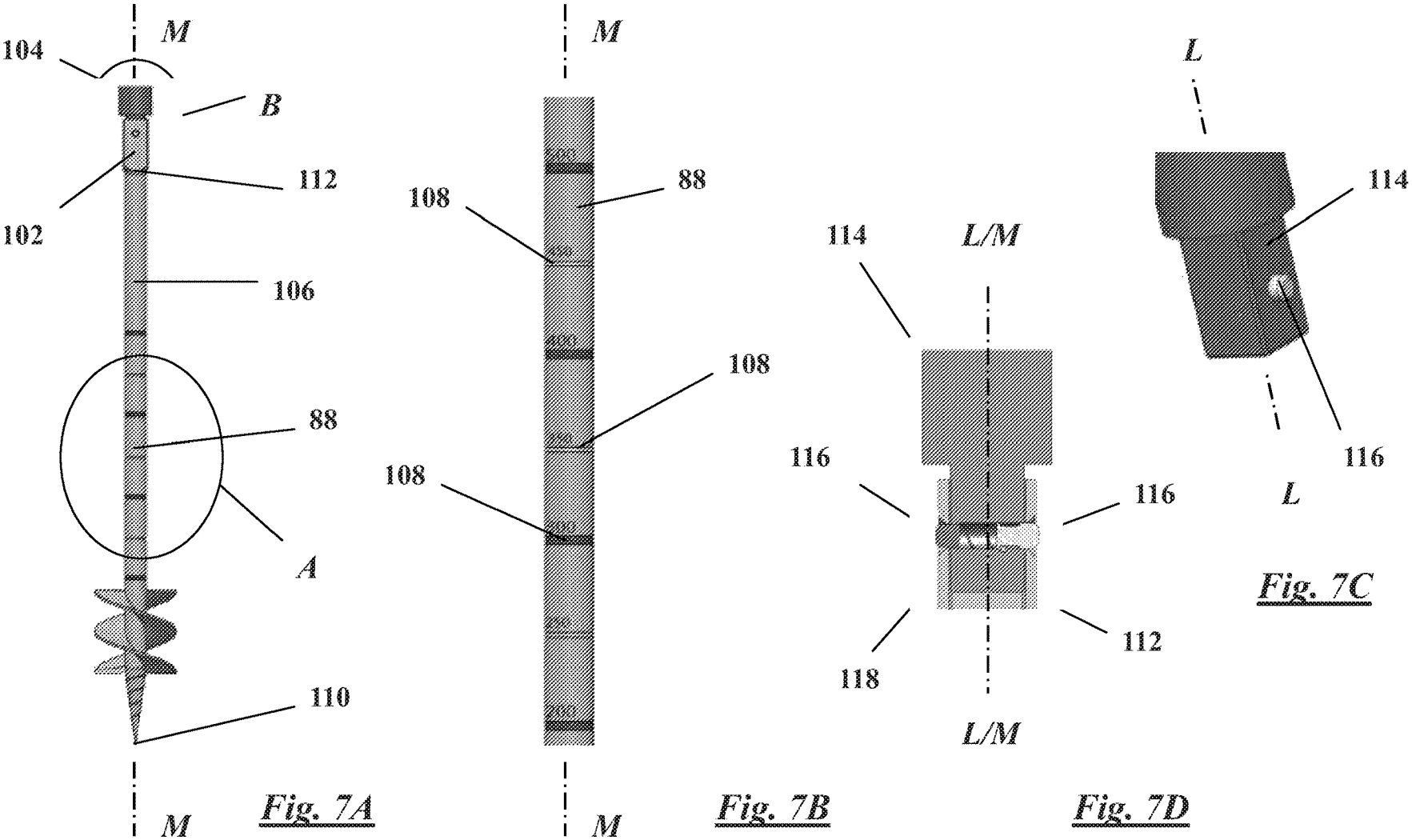
FIG. 7A is a side view of a further drilling bit for use with the digging apparatus of FIG. 1, and being shown as connected with a part of an engagement mechanism of the main body of the digging apparatus of FIG. 1.
FIG. 7B is an enlarged view of the encircled part marked A of FIG. 7A, being a part of the drilling bit shown in FIG. 7A.
FIG. 7C is a perspective view of an engagement mechanism of the main body of the digging apparatus of FIG. 1.
FIG. 7D is an enlarged view of the encircled part marked B of FIG. 7A, showing the releasable connection between the drilling bit and the engagement mechanism of the main body of the digging apparatus of FIG. 1.

FIG. 7A shows a drilling bit 88 for use with the digging apparatus 10, in which the drilling bit 88 is shown as being connected with a part of an engagement mechanism 104 of the main body 12 of the digging apparatus 10. The drilling bit 88 has a central longitudinal axis M-M which, when the drilling 88 is releasably connected with the engagement mechanism 104, is aligned with the central longitudinal axis L-L of the main body 12 and of the connection mechanism 104. To allow the user to easily know the depth to which the drilling bit 88 has penetrated into the substrate (e.g. soil), and as shown in FIG. 7B, the drilling bit 88 has on its body 106 a number of markings 108 (which may be coloring and/or etchings) to show the distance of the respective markings 108 from a tip 110 of the drilling bit 88, being one longitudinal end of the drilling bit 88.

The upper end 102 (i.e. the longitudinal end opposite the tip 110) of the drilling bit 88 has a hollow connection part 112 with a cavity of a square cross-section sized and configured to receive a part of a male member 114 of the engagement mechanism 104, which male member 114 also being of a square cross-section. The hollow connection part 112 of the drilling bit 88 has a pair of through holes with their central longitudinal axes aligned with each other.

The male member 114 includes two pins 116 with their central longitudinal axes aligned with each other. The pins 116 are movable towards each other to a compressed position and away from each other to an extended position. The pins 116 are biased towards the extended position by a spring 118. When the drilling bit 88 is connected with the engagement mechanism 104, in which the male member 114 is received within the hollow connection part 112 of the drilling bit 88, the pins 116 are in the extended position and are partly received through the through-holes of the hollow connection part 112 of the drilling bit 88 to prevent disengagement of the drilling bit 88 from the engagement mechanism 104. If desired, the pins 116 may be movable (e.g. by manually compressing the pins 116 towards each other, and against the biasing force of the spring 118) to the compressed position, in which the pins 116 are clear of the through holes of the hollow connection part 112 of the drilling bit 88, to allow disengagement of the drilling bit 88 from the engagement mechanism 104, thus allowing disconnection of the drilling bit 88 from the main body 12.

Most existing drilling bit locking mechanism makes use of a pin and key. It is time consuming to change the drilling bit. Since the drilling bit is long, it is difficult to align the hole for insertion of the pin and key. There is also the risk of losing the pin or key. On the other hand, the arrangement discussed above allows for easy and convenient connection and disconnection of the drilling bit 88 with and from the main body 12 of the digging apparatus 10, without requiring the use of any tool or accessory.

Figure 8:
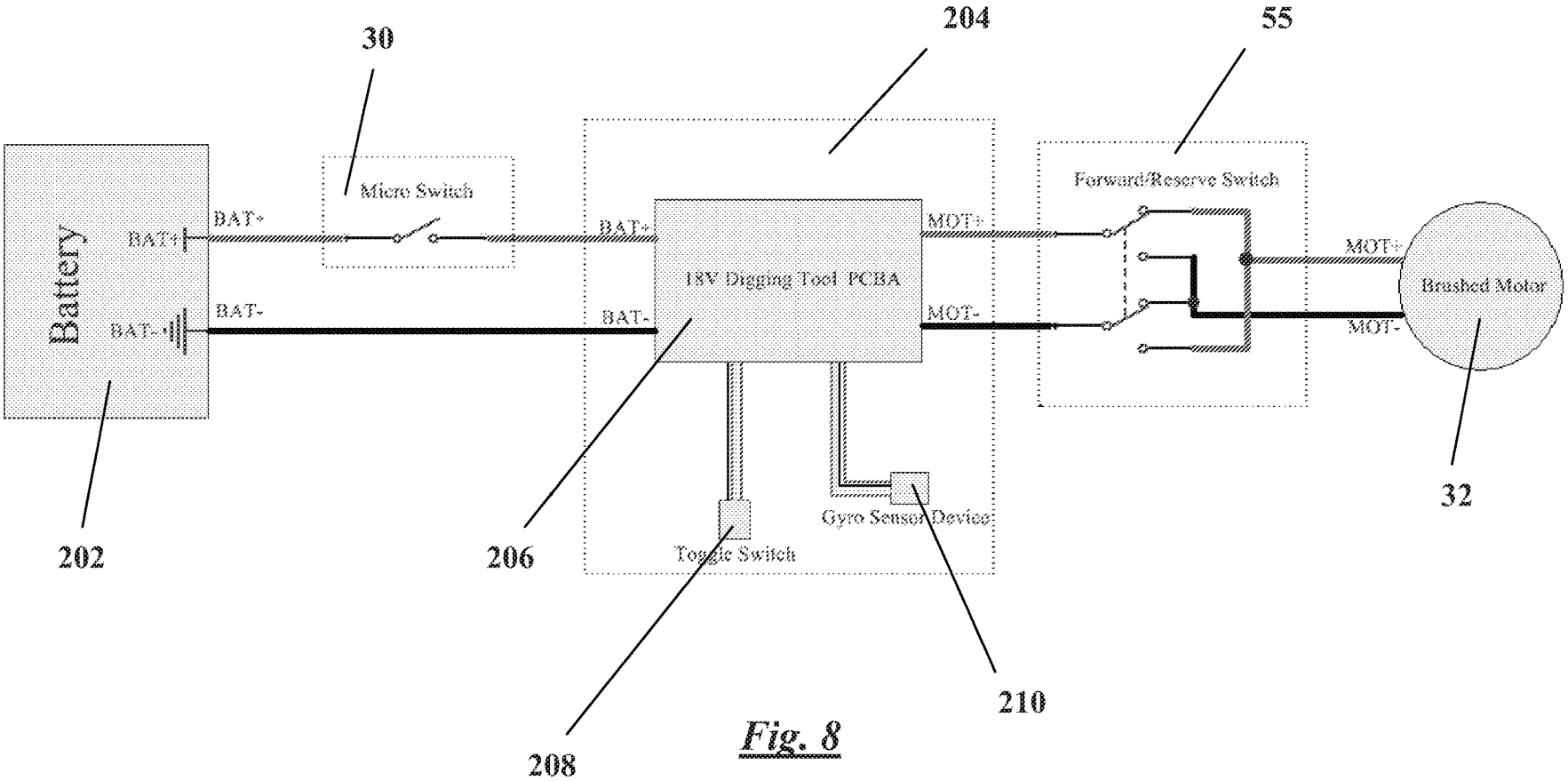
FIG. 8 is a schematic electrical connection diagram of the digging apparatus of FIG. 1.
Figure 9:
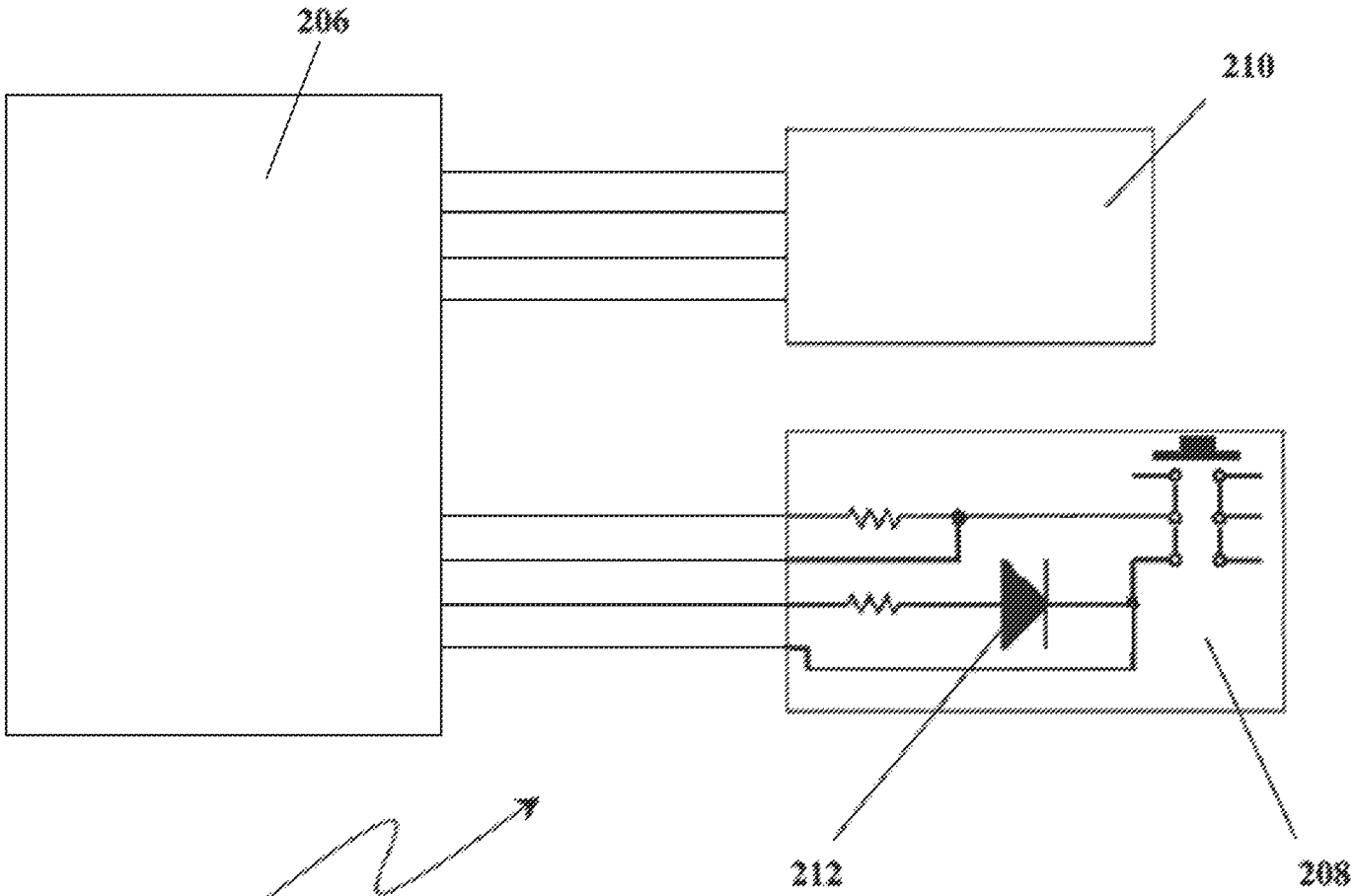
FIG. 9 is a schematic diagram of an anti-kicking module in the electrical connection diagram of FIG. 8.

A schematic electrical connection diagram of the digging apparatus 10 is shown in FIG. 8. The digging apparatus 10 is powered by a battery 202, such as a 18V lithium battery pack. The battery 202 is connected via the micro-switch 30 with a control module 204, and the control module 204 is connected via the auxiliary switch assembly 55 (which acts as a forward/reverse switch, and including the first slide switch 52 and the second slide switch 54) with the motor 32. Thus, when the micro-switch 30 is operated to close the circuit, the control module 204 is operable to control the operation of the motor 32. As shown in FIG. 8, the control module 204 includes a printed circuit board assembly (PCBA) (i.e. a printed circuit board populated with various electronic components) 206 in electrical and/or data communication with a toggle switch 208 and a gyro sensor device 210, FIG. 9 is a schematic diagram of the control module 204 in the digging apparatus 10 whose electrical connection diagram is shown in FIG. 8, which provides the anti-kickback function. The gyro sensor device 210 measures the angular velocity (also called "palstance") of the drilling bit 88, 88*a*, and transmits the relevant measurement data to the PCBA 206. The PCBA 206 also measures the magnitude of the electric current supplied to (or drawn by) the motor 30. The toggle switch 208 also includes an LED 212 which acts as a visual indicator of the status of the anti-kickback function.

Figure 10:
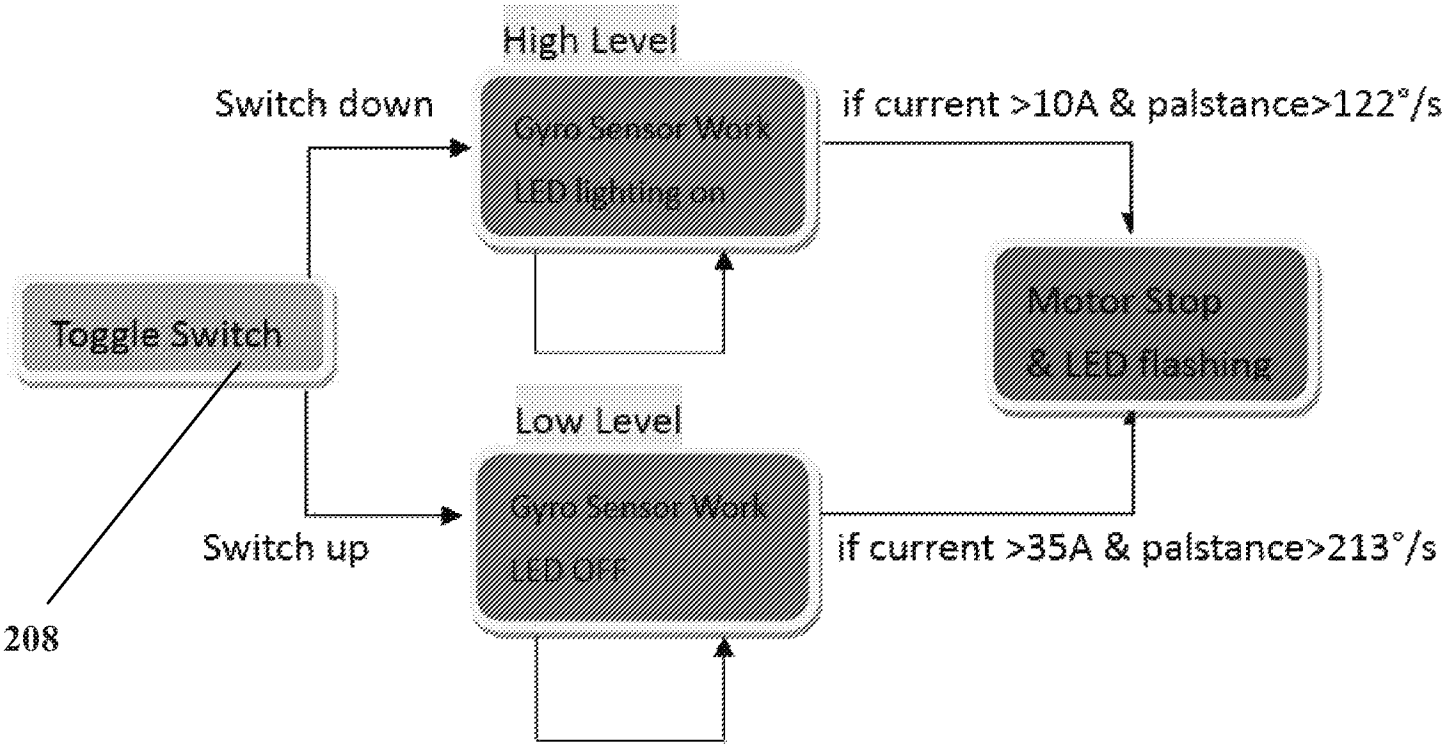
FIG. 10 is a logic control diagram of the anti-kickback function of the schematic electrical connection diagram of FIG. 8.

FIG. 10 is a logic control diagram of the anti-kickback function of the digging apparatus 10. The toggle switch 208 may be moved between a "Switch up" position and a "Switch down" position. When the toggle switch 208 is in the "Switch up" position, the anti-kickback protection function is set at a "Low Level" protection mode in which the gyro sensor device 210 measures the angular velocity of the drilling bit 88, 88*a*, and the LED 212 is off to visually indicate that the digging apparatus is in the "Low Level" protection mode. In this Low Level protection mode, the PCBA 206 will stop operation of the motor 302 if the electric current supplied to (or drawn by) the motor 30 exceeds a first threshold current value (e.g. 35 A) and the angular velocity of the drilling bit 88, 88*a* as measured by the gyro sensor device 210 exceeds a first threshold angular velocity value (e.g. 213° per second). If the toggle switch 208 is moved to the "Switch down" position, the anti-kickback protection function is set at a "High Level" protection mode in which the gyro sensor device 210 measures the angular velocity of the drilling bit 88, 88*a* and the LEI) 212 is continuously on to visually indicate that the digging apparatus is in the "High Level" protection mode. In this High Level protection mode, the PCBA 206 will stop operation of the motor 302 if the electric current supplied to (or drawn by) the motor 30 exceeds a second, lower threshold current value (e.g. 10 A) and the angular velocity of the drilling bit 88, 88*a* as measured by the gyro sensor device 210 exceeds a second, lower threshold angular velocity value (e.g. 122° per second). In any event, if the operation of the motor 30 is stopped by the PCBA 206 of the control module 204 in response to the angular velocity of the drilling bit 88, 88*a* as measured by the gyro sensor device 210 exceeding the currently set threshold angular velocity value and the electric current supplied to the motor 30 exceeding the currently set threshold current value, the LED 212 will flash to visually indicate activation of the protection function.

It can be seen that, in addition to providing anti-kickback protection function (by virtue of the operation of the motor 32 being stopped in response to a sudden large torque faced by the drilling bit 88, 88*a*, as reflected by the high angular velocity and high electric current drawn), the digging apparatus 10 allows the user to set the protection at a High Level and a Low Level, by operating the toggle switch 208, which effectively sets the threshold angular velocity and the threshold current value exceeding which the operation of the motor 30 will be stopped.

Figure 11:
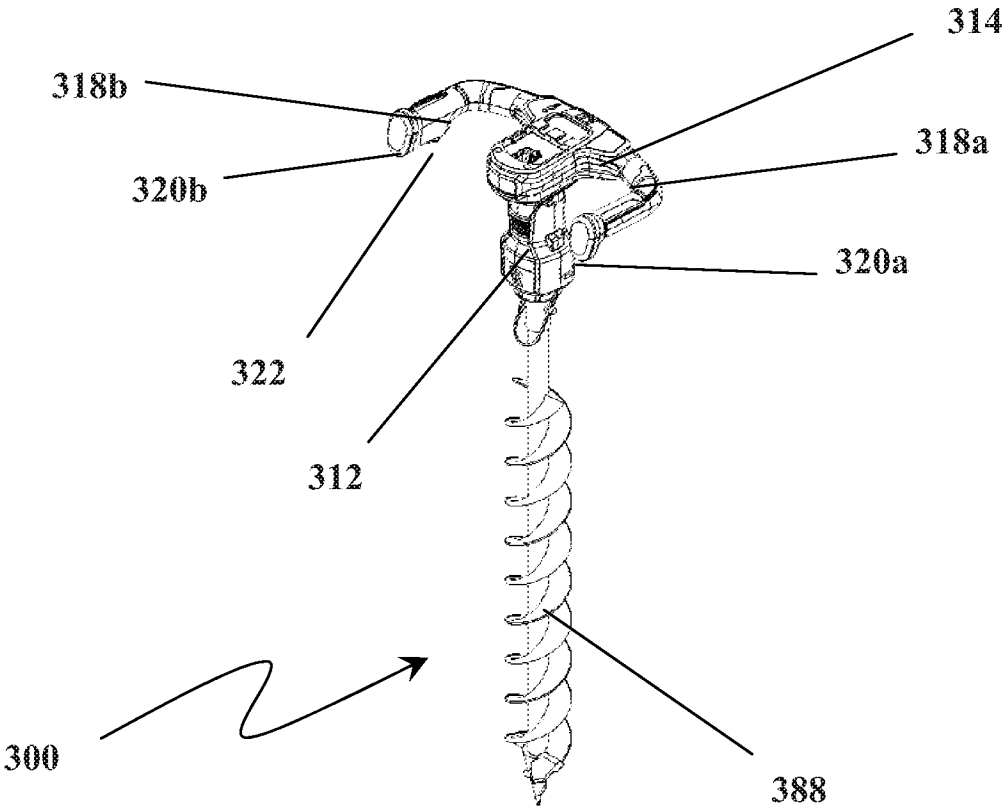
FIG. 11 is a perspective view of a digging apparatus according to a second embodiment of the present invention.

A digging apparatus according to a second embodiment of the present invention is shown in FIG. 11, and generally designated as 300. Similar to the digging apparatus 10 discussed above, the digging apparatus 300 also includes a main body 312, which houses a motor (not shown). To an upper end of the main body 312 is installed a handle assembly 314 and to a lower end of the main body 312 is releasably installed a digging tool, such as a drilling bit 388. The drilling bit 388 is operatively associated with and driven by the motor. The handle assembly 314 includes two handle portions 318*a*, 318*b*. Differences between the digging apparatus 300 and the digging apparatus 10 include:

(a) in the digging apparatus 300, free ends 320*a*, 320*b* of the respective handle portions 318*a*, 318*b* point in a same direction; and (b) in the digging apparatus 300, a main switch 322 to be operable manually by a user is provided on an underside of the handle portion 318*b*, in the form of a pivot switch. As in the case of the switch 22 in the digging apparatus, the main switch 322 is also movable between an "ON" position and an "OFF" position for operating the motor. The switch 322 is biased (e.g. by one or more springs) towards the "OFF" position.

It should be understood that the above only illustrates and describes an example whereby the present invention may be carried out, and that modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. A digging apparatus including:

a handle assembly, a motor, a switch member electrically connected with said motor, said switch member being movable between a first position in which operation of said motor is allowed and a second position in which operation of said motor is prevented, and a digging tool driveable by said motor, said digging tool having a longitudinal axis, characterized in that, when said switch member is in said first position, said motor is adapted to drive said digging tool to rotate about said longitudinal axis in a first rotational direction in response to movement of said handle assembly in a first direction, and said motor is adapted to drive said digging tool to rotate about said longitudinal axis in a second rotational direction which is opposite to said first rotational direction in response to movement of said handle assembly in a second direction which is opposite to said first direction.

2. A digging apparatus according to claim 1, wherein, in use, when said switch member is in said first position, and in response to movement of said handle assembly in said first direction, said motor is adapted to drive said digging tool to rotate about said longitudinal axis in said first rotational direction to move said digging apparatus in said first direction.

3. A digging apparatus according to claim 1, wherein, in use, when said switch member is in said first position, and in response to movement of said handle assembly in said second direction, said motor is adapted to drive said digging tool to rotate about said longitudinal axis in said second rotational direction to move said digging apparatus in said second direction.

4. A digging apparatus according to claim 1, wherein said apparatus includes an electric circuit connecting said switch member, said motor and an auxiliary switch assembly, and wherein, when said switch member is in said first position, and in response to movement of said handle assembly in said first direction, said auxiliary switch assembly is adapted to close said electric circuit in a first configuration to operate said motor to drive said digging tool to rotate about said longitudinal axis in said first rotational direction.

5. A digging apparatus according to claim 4, wherein when said switch member is in said first position, and in response to movement of said handle assembly in said second direction, said auxiliary switch assembly is adapted to close said electric circuit in a second configuration to operate said motor to drive said digging tool to rotate about said longitudinal axis in said second rotational direction.

6. A digging apparatus according to claim 4, wherein said auxiliary switch assembly includes a first auxiliary switch which, when said switch member is in said first position and in response to movement of said handle assembly in said first direction, is adapted to close said electric circuit in said first configuration.

7. A digging apparatus according to claim 6, wherein said auxiliary switch assembly includes a second auxiliary switch which, when said switch member is in said first position and in response to movement of said handle assembly in said second direction, is adapted to close said electric circuit in said second configuration.

8. A digging apparatus according to claim 7, wherein said second auxiliary switch comprises a second sliding switch (54).

9. A digging apparatus according to claim 6, wherein said first auxiliary switch comprises a first sliding switch (52).

10. A digging apparatus according to claim 1, wherein said first direction is from said handle assembly to said digging tool and is parallel to said longitudinal axis of said digging tool.

11. A digging apparatus according to claim 1, wherein said handle assembly includes two handle portions each with a free end, and wherein said free ends of said handle portions point towards generally opposite directions.

12. A digging apparatus according to claim 11, wherein said handle assembly is of a generally S-shape.

13. A digging apparatus according to claim 11, wherein said free ends of said handle portions point towards generally a same direction.

14. A digging apparatus according to claim 11, wherein said switch member is on one of said handle portions.

15. A digging apparatus according to claim 1, wherein said digging tool is releasably connected with said motor.

16. A digging apparatus according to claim 15, wherein said digging tool includes a body with markings thereon for indicating a depth of penetration of said digging tool into a substrate.

17. A digging apparatus according to claim 15, wherein said digging tool includes a first longitudinal end for penetrating into a substrate and an opposite second longitudinal end for releasable connection with an engagement mechanism of said digging apparatus, wherein said digging tool includes a hollow connection part adjacent said second longitudinal end, and wherein said hollow connection part includes two through-holes with their central longitudinal axes aligned with each other.

18. A digging apparatus according to claim 17, wherein said engagement mechanism includes a male member adapted to be inserted into said hollow connection part of said digging tool, wherein said male member of said engagement mechanism includes two pin members having central longitudinal axes aligned with each other, wherein said pin members are movable towards each other to a compressed position and away from each other to an extended position, and wherein said pin members are biased towards said extended position.

19. A digging apparatus according to claim 18, wherein when said digging tool is connected with said engagement mechanism, said pin members of said male member of said engagement mechanism are in said extended position and are at least partly received through said through-holes of said hollow connection part of said digging tool to prevent disengagement of said digging tool from said engagement mechanism.

20. A digging apparatus according to claim 19, wherein when said digging tool is connected with said engagement mechanism, said pin members of said male member of said engagement mechanism are movable from said extended position to said compressed position to allow disengagement of said digging tool from said engagement mechanism.

21. A digging apparatus according to claim 18, wherein said male member of said engagement mechanism is of a generally square cross-section.

22. A digging apparatus according to claim 21, wherein said hollow connection part of said digging tool has a cavity of a generally square cross-section.

23. A digging apparatus including:

a handle assembly;

a motor; and a digging tool driveable by said motor, wherein said digging tool is configured to rotate about an axis in a first rotational direction in response to movement of said handle assembly in a first direction, and rotate about said axis in a second rotational direction which is opposite to said first rotational direction in response to movement of said handle assembly in a second direction which is opposite to said first direction.

24. The digging apparatus of claim 23, wherein the digging apparatus further comprises a switch member electrically connected with said motor, said switch member being movable between a first position in which operation of said motor is allowed and a second position in which operation of said motor is prevented, and wherein the digging tool is configured to rotate when said switch member is in said first position.

25. The digging apparatus of claim 24, wherein said apparatus includes an electric circuit connecting said switch member, said motor and an auxiliary switch assembly, and wherein, when said switch member is in said first position, and in response to movement of said handle assembly in said first direction, said auxiliary switch assembly is adapted to close said electric circuit in a first configuration to operate said motor to drive said digging tool to rotate about said longitudinal axis in said first rotational direction.

26. The digging apparatus of claim 23, wherein said handle assembly includes two handle portions each with a free end, and wherein said free ends of said handle portions point towards generally opposite directions.

27. The digging apparatus of claim 23, wherein said digging tool is releasably connected with said motor.

28. A digging apparatus according to claim 27, wherein said digging tool includes a body with markings thereon for indicating a depth of penetration of said digging tool into a substrate.

29. A digging apparatus according to claim 27, wherein said digging tool includes a first longitudinal end for penetrating into a substrate and an opposite second longitudinal end for releasable connection with an engagement mechanism of said digging apparatus, wherein said digging tool includes a hollow connection part adjacent said second longitudinal end, and wherein said hollow connection part includes two through-holes with their central longitudinal axes aligned with each other.

* * * * *